US012575644B1

(12) United States Patent
Chu

(10) Patent No.: US 12,575,644 B1
(45) Date of Patent: Mar. 17, 2026

(54) HEEL-CUP FOR CLIMBING SHOES

(71) Applicant: Young Chu, Fullerton, CA (US)

(72) Inventor: Young Chu, Fullerton, CA (US)

( * ) Notice: Subject to any disclaimer, the term of this patent is extended or adjusted under 35 U.S.C. 154(b) by 0 days.

(21) Appl. No.: 18/889,279

(22) Filed: Sep. 18, 2024

(51) Int. Cl.
*A43B 21/36* (2006.01)
*A43B 5/00* (2022.01)

(52) U.S. Cl.
CPC ..... *A43B 21/36* (2013.01); *A43B 5/003* (2013.01)

(58) Field of Classification Search
CPC ..... A43B 5/003
See application file for complete search history.

(56) References Cited

U.S. PATENT DOCUMENTS

D516,783 S * 3/2006 Chu ..... D2/964
2003/0196354 A1* 10/2003 Chu ..... A43B 5/003 36/34 R
2004/0244226 A1* 12/2004 Farys ..... A43B 23/088 36/69
2018/0084864 A1* 3/2018 Takada ..... A43B 7/1435

* cited by examiner

*Primary Examiner* — Ted Kavanaugh
(74) *Attorney, Agent, or Firm* — Jaenam Coe

(57) ABSTRACT

A heel-cup structure for climbing shoes having increased edge-contact properties and friction on uneven surface where the heel area has a protrusion around the outer sole area under the heel and rimmed indentation between the heel counter and the outer sole. The heel-cup structure with protrusion of the outer sole made of soft, polymeric, synthetic rubber material provides a device to latch onto a thin edge of the rock surface in contact, to effectuate edging and heel-hooking.

10 Claims, 9 Drawing Sheets

-- PRIOR ART--

—PRIOR ART—

HEEL-CUP FOR CLIMBING SHOES

SUMMARY

This invention relates to a heel-cup structure to be incorporated in manufacturing climbing shoes as integral part to provide increased friction and latching properties for the heel areas of the climbing shoes on the rock surfaces in contact, facilitating a more effective heel use in various climbing postures.

Some of the main functions of climbing shoes are to facilitate latching on a hold ("edging" and "hooking") or to prolong the contact between the climber's shoe and the surface of the rock through friction ("smearing") enabling the climber's body to move forward using the contact point between the climbing shoes and features on the surface of the rock as a temporary anchor for the climber's foot. This is achieved partly through the employment of proprietary soft and flexible polymeric material, namely synthetic rubber with a high friction coefficient ("rubber"), on the sole, toe, and heel area of the climbing shoes making contact with the rock surface. The design of the various contact point of a climbing shoe is aimed to aid the employment of climbing techniques, such as edging, hooking or smearing.

As is known, some models of climbing shoes available on the market comprise a leather and/or fabric shoe-upper which is substantially sock-shaped to accommodate and cover the foot of the user, including the sole; various tensioning bands made of high-elasticity elastomeric material, which are fixed by gluing to the tip of the shoe-upper to surround the tarsus-phalangeal portion or the rear part of the user's foot; and a sole made of rubber with a high friction coefficient and substantially inextensible, which is fixed by gluing to the bottom of the shoe-upper to only cover the front part of the bottom of the shoe-upper, locally overlapping the tensioning band. Some other models of climbing shoes available on the market employ strings or straps with hook-and-loop type fasteners on the shoe-upper to tighten and keep the tension on the frontal part of the shoe. These various devices for tightening the front area of a climbing shoe address the enablement of friction-induced latching or anchoring by the toes and other parts of the forefoot of the climber. The tension-induced covering of the frontal foot of the climber by the climbing shoe with a sharper profile produced by the frontal sole and toe box area allows the climber's toe to latch on the thinnest hold on the rock surface. Using the frontal part of the climbing shoes for latching on the imperfections of the rock surfaces involves much of the climber's moves, and this function is mostly addressed by the current designs of the climbing shoes.

There are occasions, however, when a climber wishes to use the heel for edging, smearing or hooking on a thin ridge or other imperfections on the rock surface as turning the foot around to engage the frontal foot area is impractical or impossible. The anatomical inefficiency of the heel area of present climbing shoes, shaped like a ball in comparison to the pointed toe area, leaves the current climbing shoes wanting a device to allow more efficient latching, smearing or hooking properties. A smooth, ball-shaped heel on the current climbing shoe, conforming to the natural shape of the anatomy, fails to provide tools to engage in hooking on the holds or features on the rock surfaces, ranging from a thin ledge to an angular facia.

The primary object of the invention is to provide a method for manufacturing climbing shoes with an outer heel-cup structure to be incorporated on climbing shoes which is capable of decreasing or eliminating these drawbacks, which can be manufactured easily and which is durable.

The present invention incorporates a "Hooking Rim" or a protrusion in the heel area of the climbing shoes for inducing appreciably significant improvement in edging or hooking the heel on the rock surface. The heel-cup design of the climbing shoe with hooking rim or a protrusion pronounced with imbedded indentation between the heel-counter and the outer sole allows additional friction on the contact surface of the rock. The ribbed pattern on the heel cup also provides additional friction coefficient thus allowing the climber additional moment of contact with the rock surface to move on using the hooking point as a temporary anchor.

The aim of the present invention is to provide a climbing shoe that is capable of allowing the user additional advantages in "heel hook" or "heel edging" on the contact surface by allowing the climber's foot to gain additional friction between the heel and the contact surface at various contact angles.

To achieve these aims, according to the present invention, a climbing shoe is provided as defined in Claim 1 and preferably, though not necessarily, in any dependent claims.

DESCRIPTION

The present invention will be described in connection with preferable embodiments thereof, wherein reference will be made to the accompanying drawings. In the drawing:

BRIEF DESCRIPTION OF THE DRAWINGS

The present invention will now be described with reference to the accompanying drawings, which illustrate a non-limiting embodiment thereof, in which:

FIG. 5.B. is a view of the rear part of the present heel cup structure as employed in a climbing shoe represented in dotted lines.

DETAILED DESCRIPTION

Figure 1:
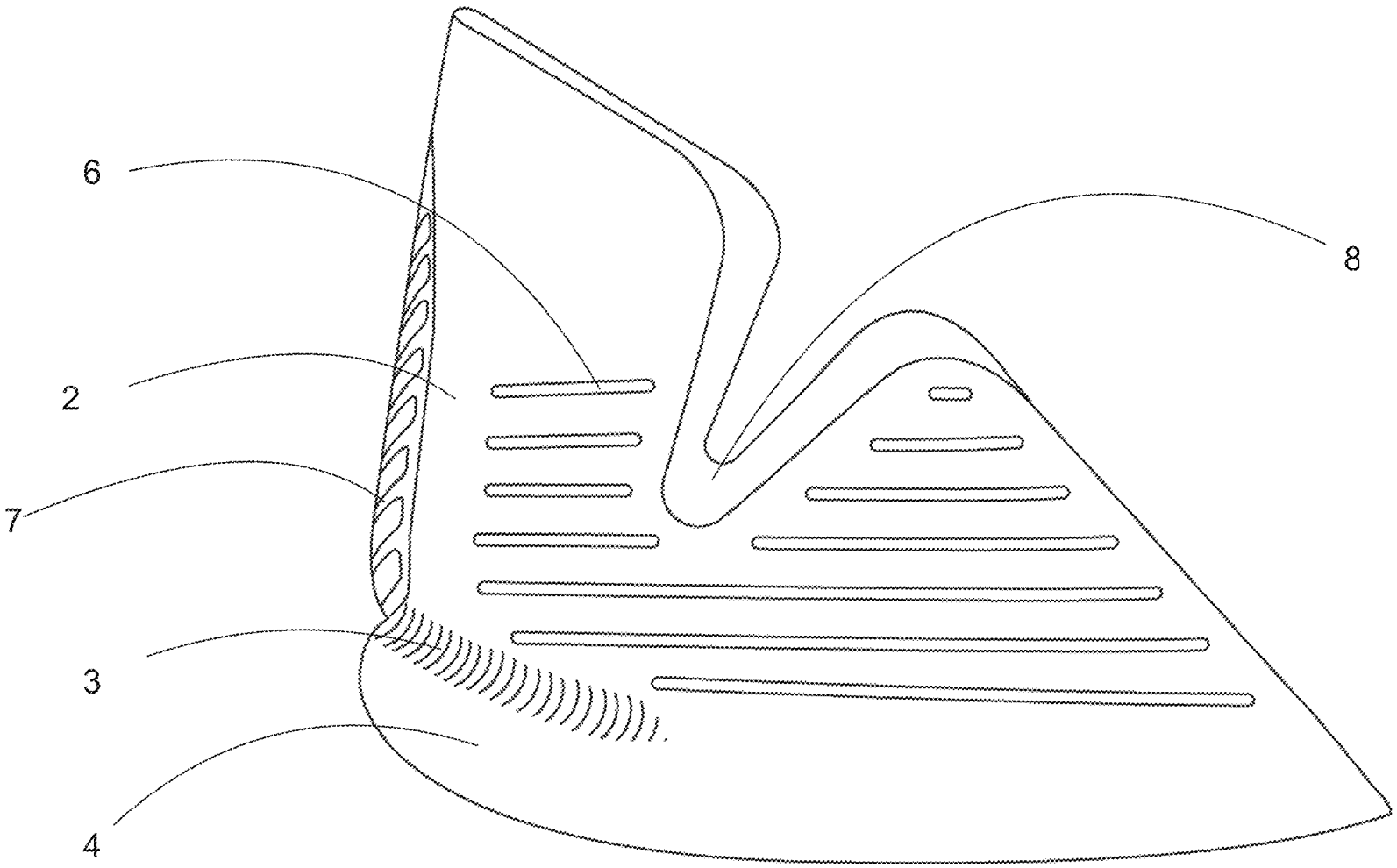
FIG. 1 is a lateral, exterior view of the heel cup structure realized according to the teachings of the present invention.
Figure 4:
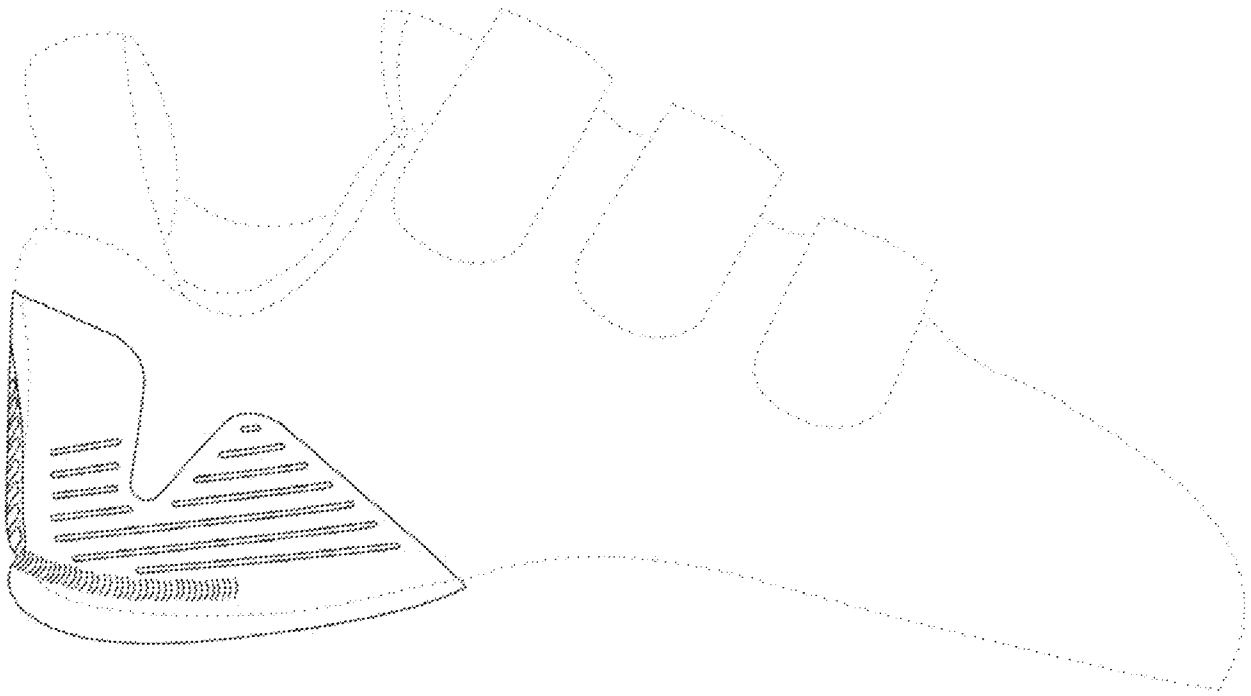
FIG. 4. is a perspective view of the heel cup structure as attached on a climbing shoe.
Figure 5A:
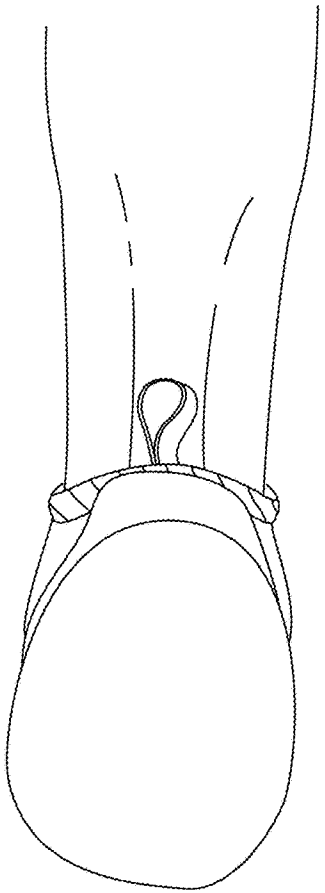
FIG. 5.A is a view of the rear part of the conventional heel cup structure as employed in currently available climbing shoe worn by a climber.
Figure 5B:
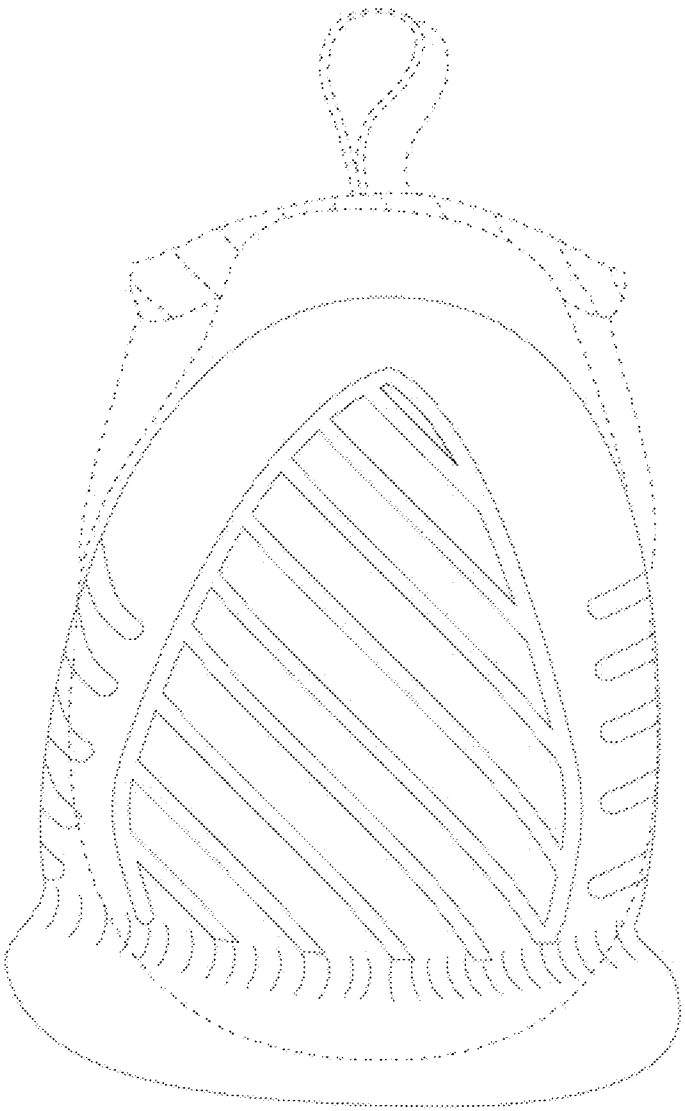
Figure 6:
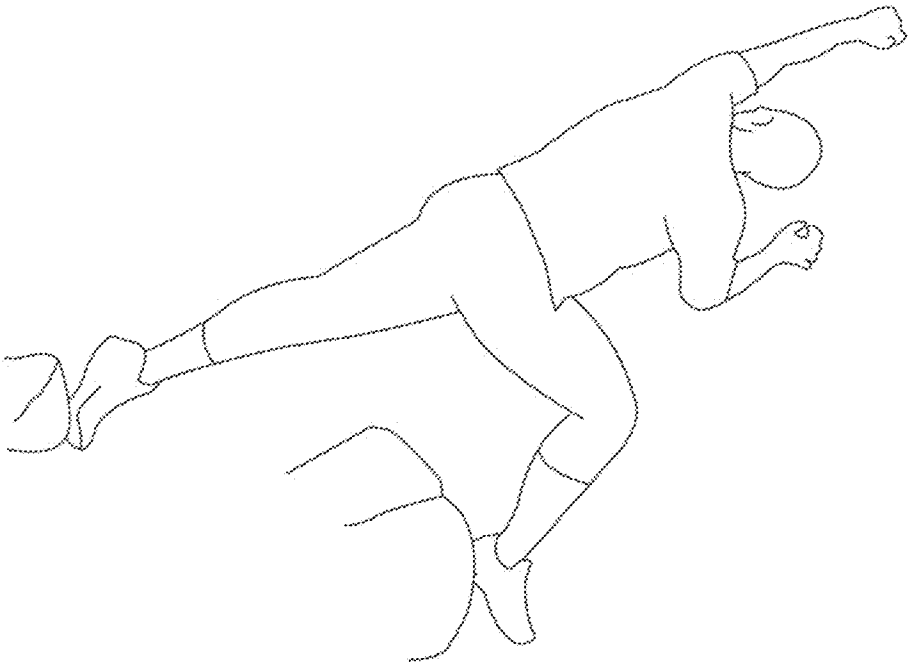
FIG. 6. is an illustration of a climber engaged in "heel-hooking" activity.
Figure 7:
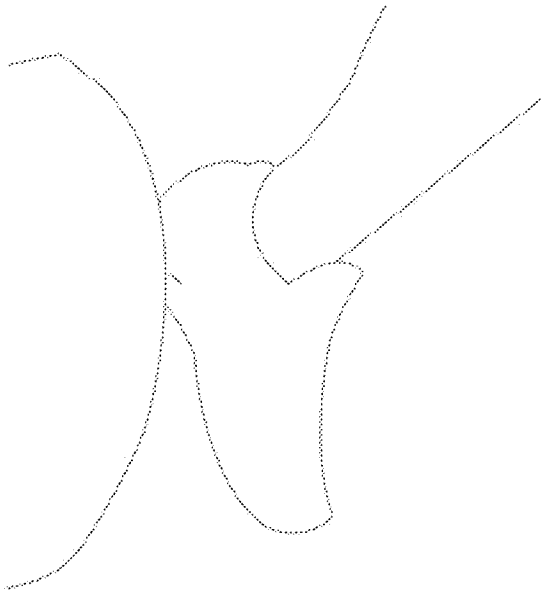
FIG. 7. is close-up view of the heel area of the climber engaged in "heel-hooking" activity.

As shown in FIG. 1, the present invention is an outer heel cup structure to be attached as a part of a climbing shoe in FIG. 4. As in the FIG. 1 and FIG. 2, the upper part or heel counter 2 covers the lateral and posterior areas of the heel. The indentations 3 and 3*a*, run through most of the outer lateral part as in the FIG. 2, extends through the anterior part of the heel and stops short, in the middle of the inner lateral part as in FIG. 1. The indentation, 3*a*, runs through the lower part of the heel counter begins above platar fascilits on the outer lateral side (3*a*), i.e. away from the core of the body of the climber or the little toe side, continuously around the back of the heel and stops shorter on the inner lateral side (3), i.e. the core of the body of the climber or the big toe side. The resulting faux outer sole or "Hooking Rim" (4, 4*a*), protrudes around the bottom of the heel cup as is evident on the comparison drawings of FIGS. 5A (conventional), and 5B (present invention).

Figure 2:
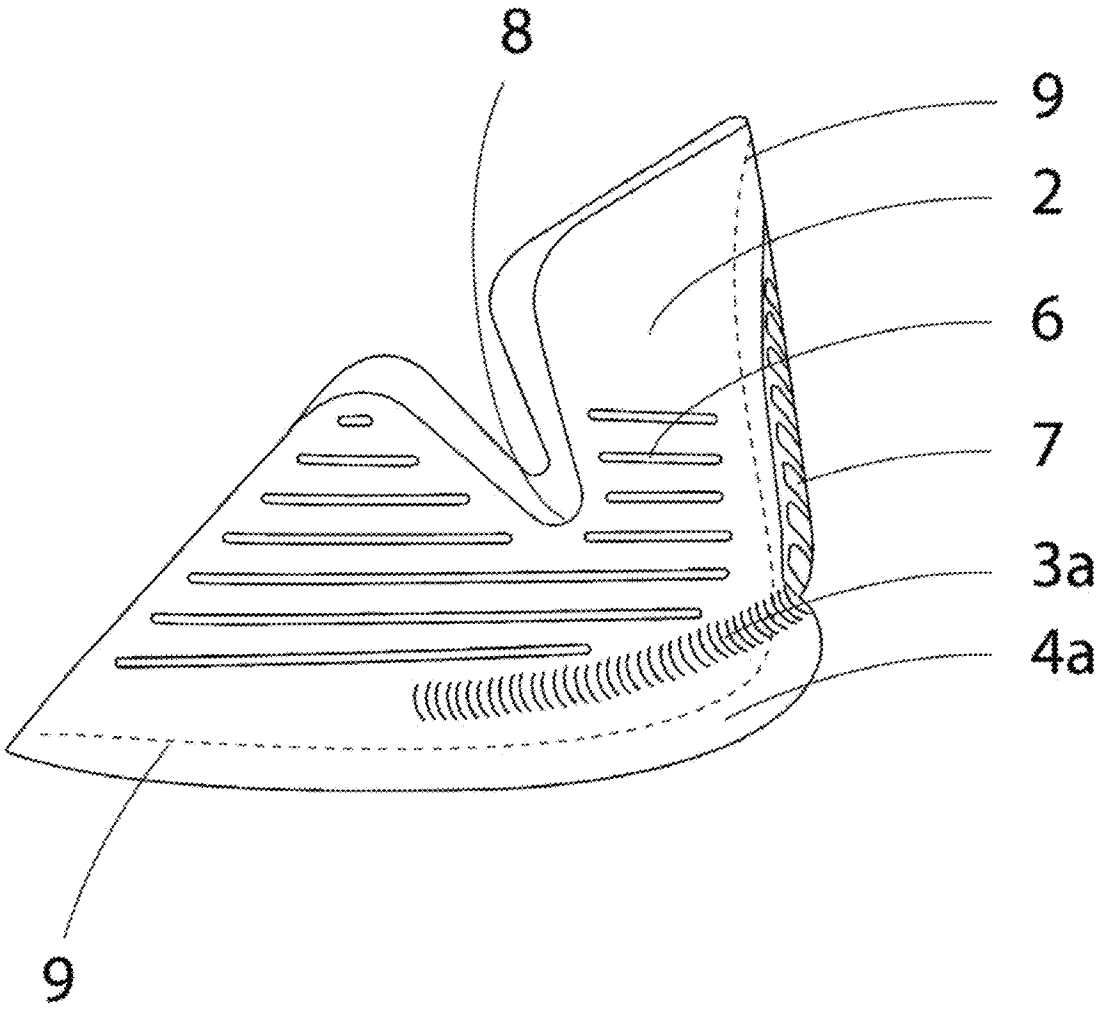
FIG. 2 is a view of the opposite side of the heel cup structure shown in FIG. 1.
Figure 3:
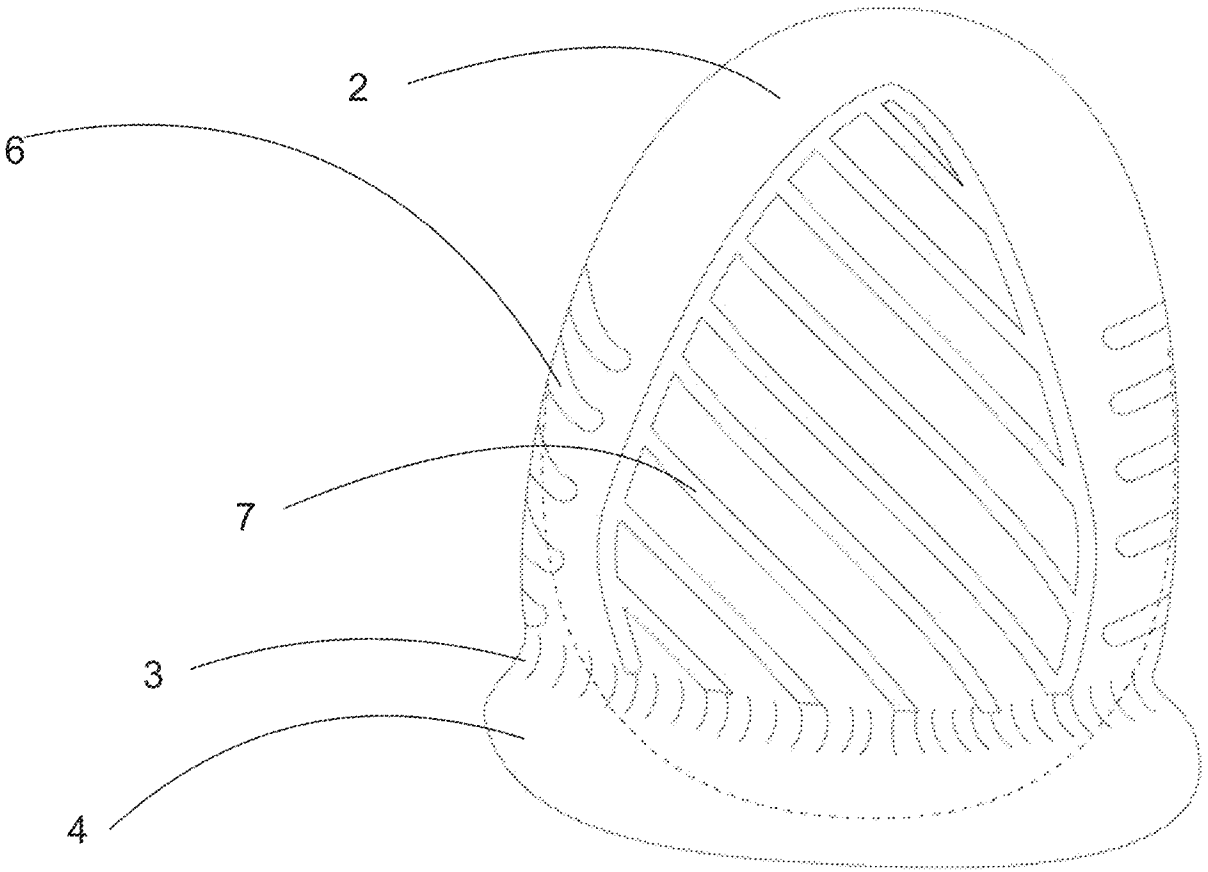
FIG. 3 is a view of the rear part of the heel cup structure shown in FIG. 1.

As shown with dotted line 9, in FIG. 2, illustrates the inner thickness of the heel-cup. The dotted line (10) in FIG. 3, represent the inside of the heel cup. As shown in FIG. 2 and FIG. 3, the inner shape, shown by dotted lines (9 and 10) of the heel cup, does not correspond with the indentation (3, 3*a*). The faux outer sole or the Hooking Rim (4 and 4*a*) appear to be an outer sole. The protrusion (4) is not a true outer sole, but rather a rim around the outer edge around bottom of the heel-cup.

The ribbed patterns (6, 7) represent the features on the surface of the heel-cup that provides additional friction when placed on the hold or other features on the surface of the rock.

The "V-shape" cut (8) on the lateral top sides of the heel cup assist adjustment of the heel-cup when being attached to as a part of the climbing shoe, to conform to the shape of the heel.

Figure 8:
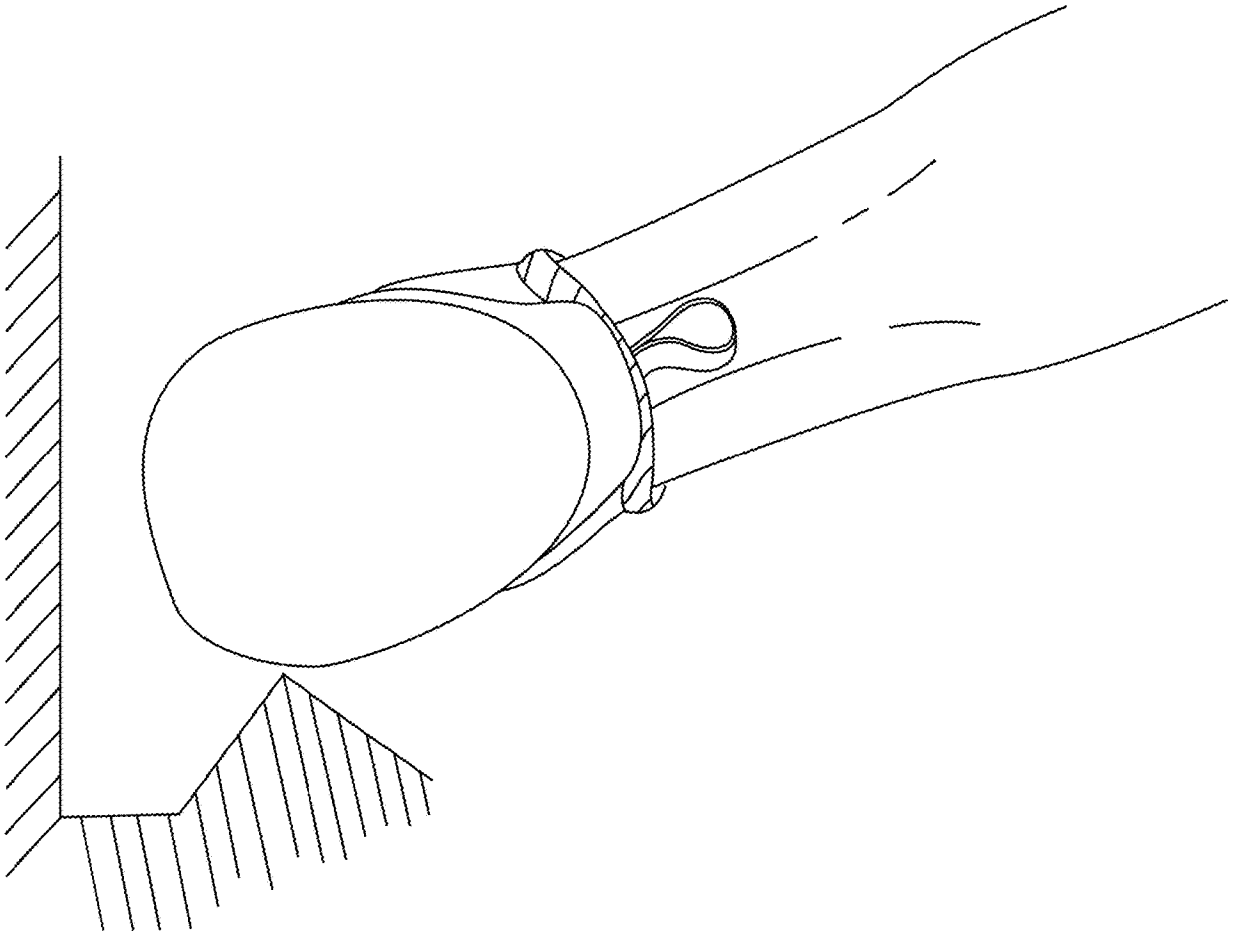
FIG. 8. is a schematic view of the contact area of a conventional climbing shoe and edge of a rock surface.
Figure 9:
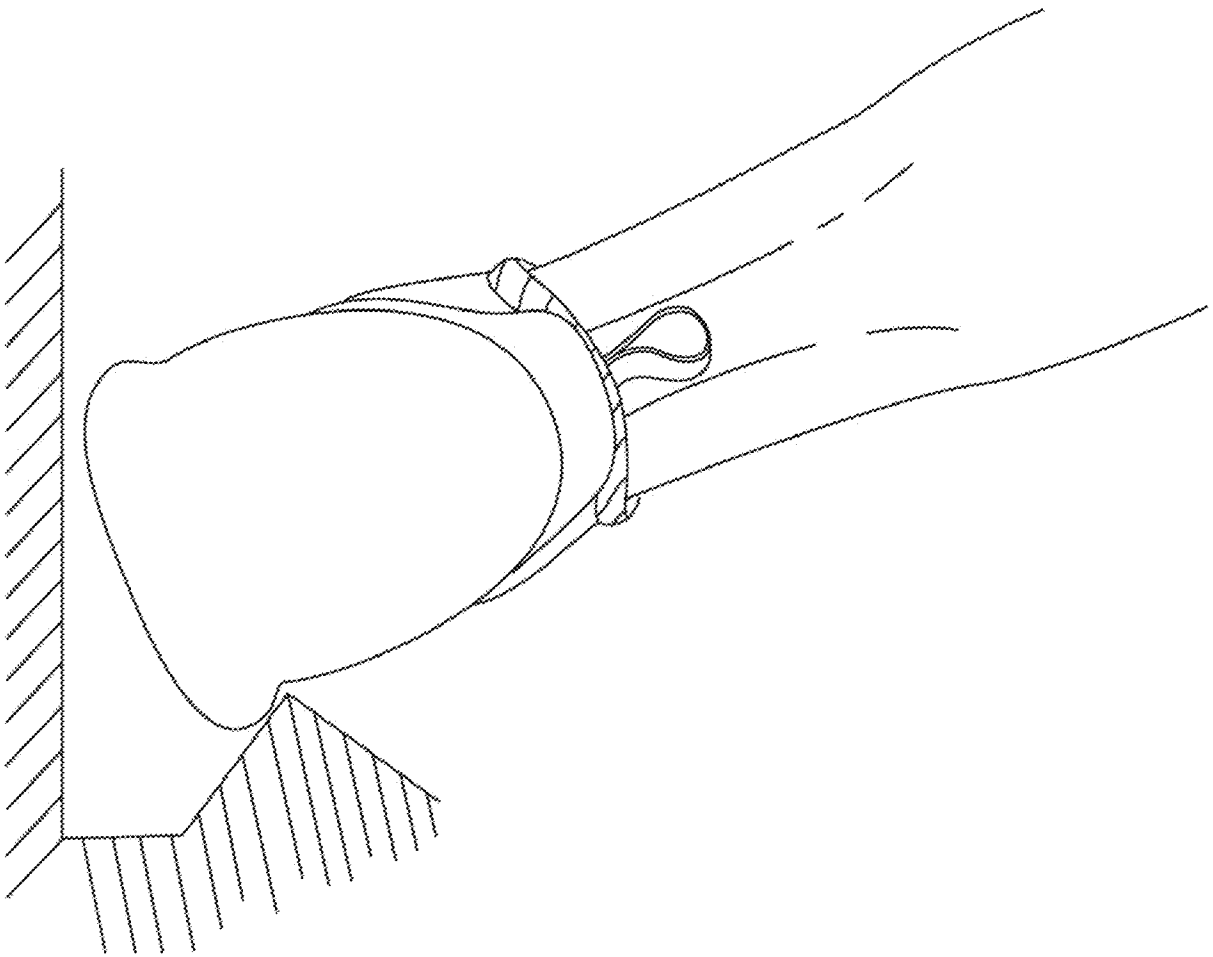
FIG. 9. is a schematic view of the contact area of a climbing shoe equipped with the present heel-cup structure and the edge of a rock surface.

As FIG. 3 shows the protrusion, or "Hooking Rim" (4) extends beyond the outer boundaries of the heel counter (2) effectuating the latching of Hooking Rim onto a protrusion FIG. 9. This would have been impossible in conventional climbing shoe, FIG. 8.

What is claimed is:

1. A heel-cup structure for climbing shoes where the heel-cup structure has a slanted open top, an inner surface shaped to be attached to as a part of a climbing shoe, and an outer surface with an upper part and a lower part, which are divided by an indentation, where the upper part forms a heel counter with a structure of ribbed patterns, the indentation is situated below the upper part and above the lower part, and the lower part that has a Hooking Rim, wherein the Hooking Rim has a protrusion of the outer surface of the heel-cup structure, surrounding a calcaneus of a user's foot in a horseshoe shape.

2. The heel-cup structure as claimed in claim 1, wherein the heel-cup structure is made of flexible polymeric material.

3. The heel-cup structure as claimed in claim 1 wherein the indentation has a depth of more than 2 mm.

4. The heel-cup structure as claimed in claim 1 wherein the indentation is imbedded along the perimeter of the lower end of the heel counter of the heel-cup forming a dividing line between the heel counter and the Hooking Rim.

5. The heel-cup structure as claimed in claim 1 wherein the Hooking Rim protrudes at least 5 mm from the indentation.

6. The heel-cup structure as claimed in claim 1, where the structure of ribbed pattern consists of repeating grooves, or ribbed lines, formed by repeated surface indentations.

7. The heel-cup structure as claimed in claim 1, where the ribbed pattern has depths of more than 1 mm.

8. The heel-cup structure as claimed in claim 1, where the ribbed pattern has repeating grooves that are horizontal on the back side of the heel-cup, and slanted on the lateral sides of the heel-cup.

9. The heel cup structure as claimed in claim 1 where the ribbed pattern has grooves that are embedded at angles, on the outer surface of the heel cup.

10. The heel-cup structure as claimed in claim 1 where the top end of the upper part incorporates a cut in the shape similar to the letter "v".

* * * * *